US006957673B2

(12) United States Patent
Ambrose et al.

(10) Patent No.: US 6,957,673 B2
(45) **Date of Patent: *Oct. 25, 2005**

(54) FUEL DISPENSING DEVICE EQUIPPED WITH A SOUND AND/OR VIDEO SYSTEM

(75) Inventors: Alan S. Ambrose, Midland, MI (US); James D. Ferguson, Mt. Pleasant, MI (US); Robert Lilienfeld, Ann Arbor, MI (US); Mark J. McKinley, Kawkawlin, MI (US); Timothy Mishler, Beaverton, MI (US)

(73) Assignee: Advanced Information Systems, LLC, Saginaw, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/624,180

(22) Filed: Jul. 22, 2003

(65) Prior Publication Data

US 2004/0194850 A1 Oct. 7, 2004

Related U.S. Application Data

(63) Continuation of application No. 08/515,438, filed on Aug. 15, 1995, now Pat. No. 6,648,031, which is a continuation-in-part of application No. 08/262,422, filed on Jun. 20, 1994, now Pat. No. 5,458,170.

(51) Int. Cl.[7] ..... B65B 1/04
(52) U.S. Cl. ..... 141/94; 141/392
(58) Field of Search ..... 141/98, 392, 94

(56) References Cited

U.S. PATENT DOCUMENTS 5,273,087 A * 12/1993 Koch et al. ..... 141/94
6,648,031 B1 * 11/2003 Ambrose et al. ..... 141/94

* cited by examiner

*Primary Examiner*—Steven O. Douglas
(74) *Attorney, Agent, or Firm*—Reising, Ethington, Barnes, Kisselle, P.C.

(57) ABSTRACT

A fuel dispensing nozzle and boot therefor that includes a sound system and/or video system which contains prerecorded messages for playback during refueling by a user of the fuel dispensing nozzle. The sound system and/or video system includes a speaker for playback of audio messages. A switch is also included to initiate the playback of messages. The switch can activate the system when the nozzle is inverted to pump fuel or can activate the system in response to squeezing of the handle actuator used to control fuel flow through the nozzle.

21 Claims, 3 Drawing Sheets

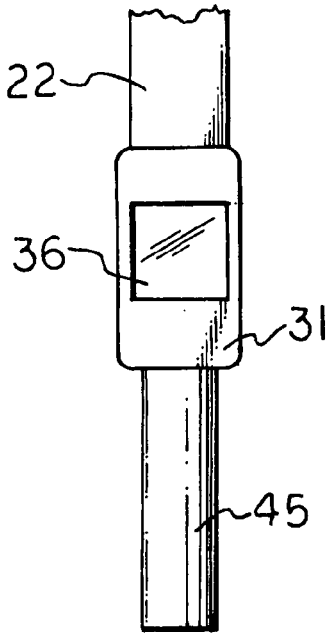
Fig. 6
Fig. 7
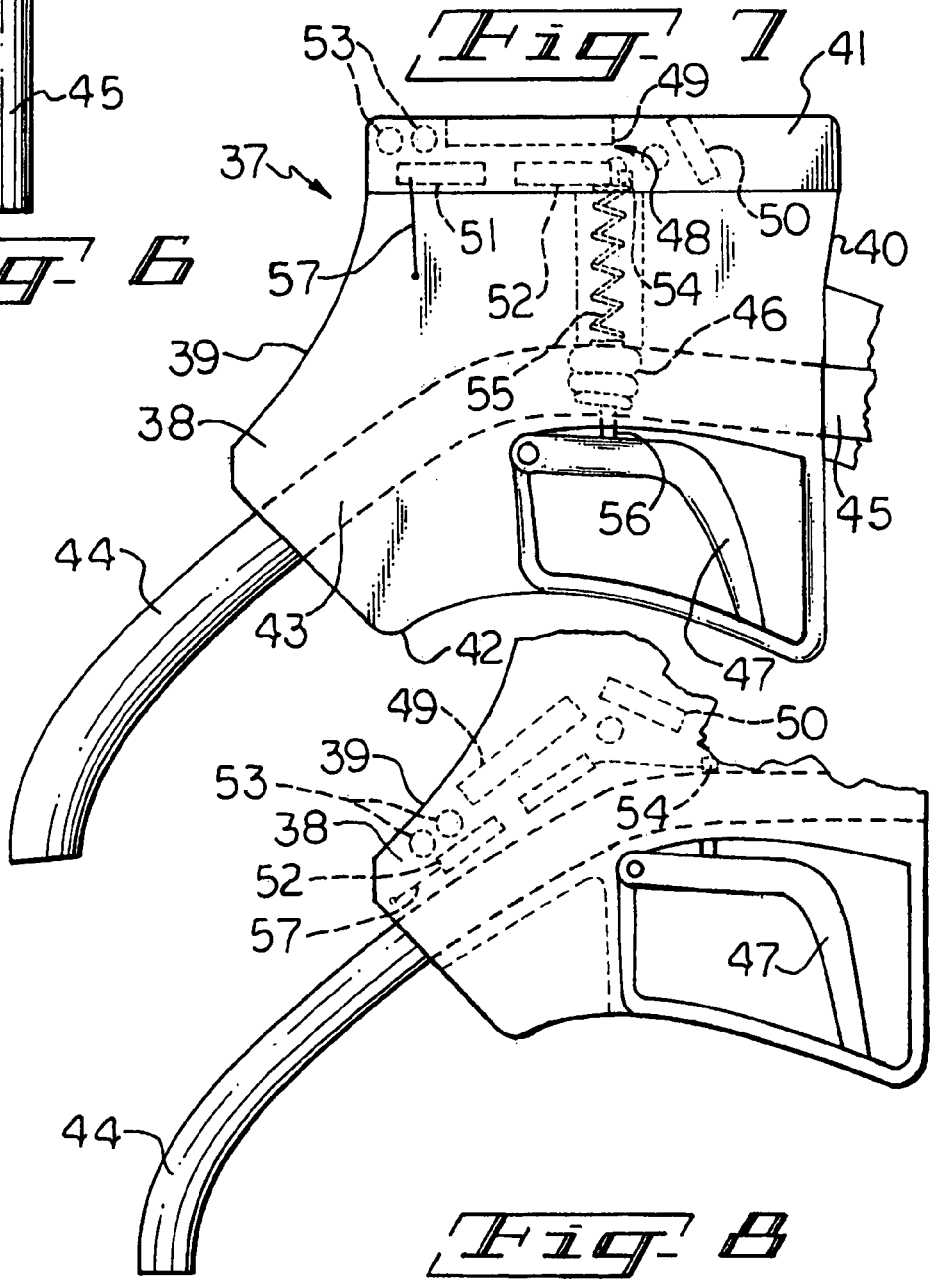
Fig. 8

FUEL DISPENSING DEVICE EQUIPPED WITH A SOUND AND/OR VIDEO SYSTEM

CROSS-REFERENCE TO RELATED APPLICATIONS

This application is a continuation of U.S. Ser. No. 08/515,438 filed Aug. 15, 1995, now U.S. Pat. No. 6,648,031, which is a continuation-in-part of U.S. Ser. No. 08/262,422 filed Jun. 20, 1994, now U.S. Pat. No. 5,458,170.

TECHNICAL FIELD

This invention deals with novel fuel dispensing devices which are equipped with sound and/or video systems which deliver messages and sounds, which sounds and/or video systems may be hard-wired or wireless.

The primary but not exclusive function of the devices or systems is to provide a flexible boot for a fuel dispensing device which contains a sound or video system to deliver messages or sounds as the fuel is being pumped into a vehicle. Such apparati are generally designed such that they are activated when the nozzle is inverted to pump fuel into the vehicle and are deactivated when the nozzle is replaced in the fuel pump stand.

The most fundamental benefit for these types of devices is for advertising various goods and services of local merchants, providing safety messages, and providing good will messages to all customers that fuel their own vehicles.

There are nearly 210,000 service stations in the United States today in which devices of the type described herein could be used.

BACKGROUND OF THE INVENTION

Although the inventors herein are not aware of any device that is similar in appearance or function to the devices of the instant invention, there is at least one patent dealing with a similar part of the instant invention.

That disclosure can be found in U.S. Pat. No. 5,184,655 to Fell, in which there is described a message display boot for fuel dispensing nozzles. The boot is of the type that is conforming to the outside of a fuel nozzle and it contains a flat message display platform mounted on the top surface of the boot. It has a clear overlay, which is used to protect any printed message placed on the platform from the elements and the fuels being dispensed.

However, the patent to Fell does not include, describe, show, or imply the devices of the instant invention.

THE INVENTION

This invention essentially consists of several embodiments, the novel boot configuration; the novel boot configuration containing the wireless sound or video system, the combination of the fuel dispensing device, the boot containing the wireless sound or video system, including an activating switch for the sound and/or video system, a modified embodiment that is useful for adaptation to the fuel hose rather than the fuel nozzle, and a nozzle that has a hollow cavity to enable one to mount a sound and/or video system therein without having to use a separate boot.

Thus, as noted above, one of the primary but not exclusive functions of the device or system is to provide a flexible boot for a fuel dispensing device, which boot contains a wireless sound or video system for messages or sounds as the fuel is being pumped into a vehicle. The apparati are designed such that they are activated when the fuel dispensing device is inverted to pump fuel into the vehicle and are deactivated when the fuel dispensing device is brought to vertical or near vertical. Thus, the device can be deactivated (switched off) by mere vertical orientation of the fuel dispensing device, however, preferred is a situation in which inverting the fuel dispensing device initiates the deactivation, and then some other method actually deactivates the device after a short message, or a series of short messages have been played.

The invention also includes the combination of the novel boot containing the wireless sound or video system with a fuel dispensing device which has an activating-deactivating switch for the wireless sound or video system. Preferred for this invention is the placement of the activating-deactivating switch in the housing which holds the sound or video system, however, the switch can be placed outside of the housing, for example, at the handle of the fuel dispensing nozzle.

Thus, there is provided a flexible boot for a fuel dispensing nozzle, said boot comprising a flexible boot adapted for a close conforming fit over at least a front portion of the fuel dispensing device. The boot has integrally surmounted thereon, a housing for a sound or video system.

In a further embodiment, the housing of the flexible boot contains therein, a wireless sound or video system.

Further, the wireless sound or video system has electrically linked thereto a switch for activating and deactivating said sound or video system. Generally, one convenient location for such a switch is on the handle of the fuel dispensing device, however, as indicated above, the most preferred location is in the housing containing the sound and/or video system.

Further, it is contemplated within the scope of this invention that the devices of this invention can be programmed, operated or controlled from a location remote from the fuel dispensing device where a device of this invention is being used. Still further, it is contemplated within the scope of this invention the activating or deactivating of the switch from remote locations, other than at the fuel dispensing device. It is intended within the scope of this invention to include both wired and wireless access including but not limited to amplitude modulation (AM), frequency modulation (FM), digital, infrared and the like, all frequencies and modes.

The inventors herein intend to include operation, control, programming, playback and receiving among the capabilities of the sound and/or video systems utilized in the instant invention.

In yet another embodiment, there is disclosed herein a method of providing a pre-recorded message during the fueling of a vehicle having a fuel port. The method comprises the utilization of a fuel dispensing pump which is equipped with a fuel dispensing device of this invention, which fuel dispensing device is in a deactivated position at the beginning of the fueling. Most commercial fueling pumps have a port in the pumping stand to accommodate the fuel dispensing device, in which the nozzle of the fuel dispensing device rests when it is not being used. When the nozzle is in the resting, or deactivated position in this port, the device of this invention is deactivated and no sound or message can be seen or heard therefrom. However, removing the fuel dispensing device from the deactivated position and placing the nozzle in the fueling port of the vehicle activates the switch, because the operator necessarily has to invert the nozzle to enter the vehicle fuel port. This activation in turn activates the sound or video system into a mode whereby a message is rendered audible or visible for a short period of time, or for the duration of the fueling of the vehicle, or a program can be featured from a remote location.

There is also contemplated within the scope of this invention the use of a device which is adaptable to a fuel dispensing hose.

Finally, there is contemplated within the scope of this invention a fuel dispensing nozzle comprising a housing having a front end, a back end, a top and a bottom and a fluid flow passage extending through the housing, the fluid flow passage terminating in a spout on the front end and terminating in a fluid channel on the back end.

There is also a valve system located in the fluid flow passage to control the flow of fluid and a handle located at the bottom of the housing and near the back of the housing. The handle is connected to the valve system to activate and deactivate the valve system. The housing contains a hollow cavity, the hollow cavity being capable of containing a system selected from a sound system, a video system, or a combination of a video system and a sound system. There can also be a switch located adjacent the system for activating and deactivating the system, if desired.

BRIEF DESCRIPTION OF THE DRAWINGS

FIG. 6 is a full back view of a nozzle of this invention showing a video screen insert 36.

FIG. 7 is a full side view of another embodiment of a nozzle of this invention showing a cavity near the top of the housing which accommodates a sound and/or video system.

FIG. 8 is a partial side view of another embodiment of a nozzle of this invention showing a cavity near the front end of the housing.

DETAILED DESCRIPTION OF THE DRAWINGS WITH REGARD TO THE INVENTION

Figure 1:
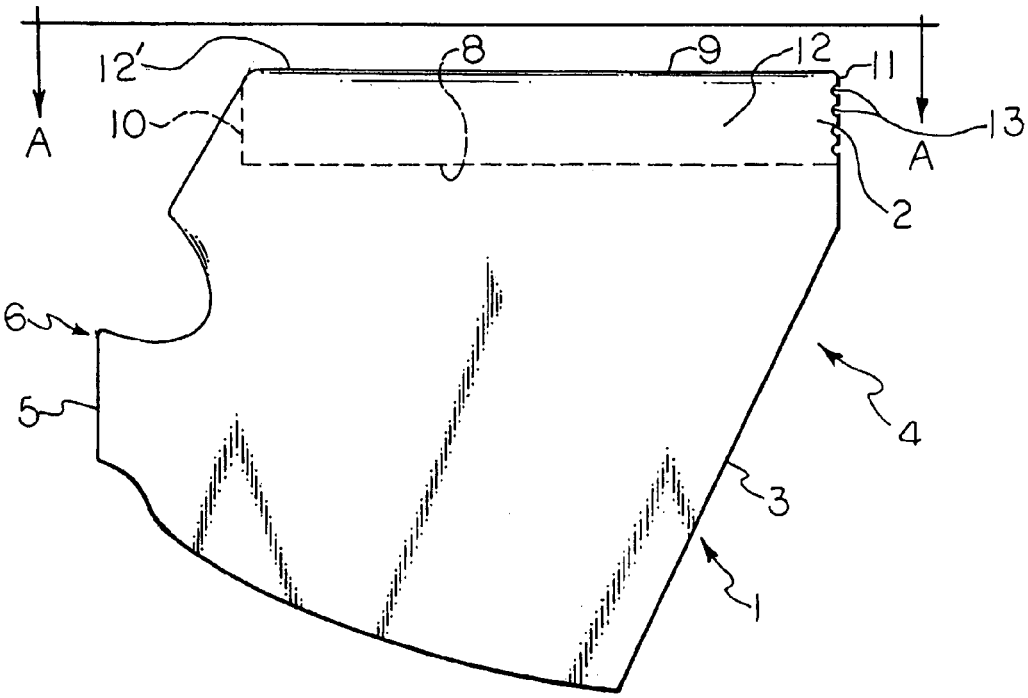
FIG. 1 is a full side view of a flexible boot of this invention.

For purposes of illustrating and disclosing the invention herein to those skilled in the art, and with regard to FIG. 1, there is shown a full side view of the flexible boot 1 of this invention.

The boot is manufactured from flexible, pliable plastic so that it can conform essentially to the outside surface of the nozzle/handle combination of a delivery system for fuel. Such boots are known in commerce today and can be observed on most commercial fuel pump systems, except, the boot of this invention has a unique feature which allows it to have a dual purpose that is not possible with the boots of commerce. Thus, it can be observed from FIG. 1 that the boot of this invention has a housing 2 (shown in phantom in FIG. 1, but in cross-section in FIG. 2), integrally molded into and forming part of the boot 1, which housing 2 is utilized in this invention to house a sound and/or video system which will be detailed infra.

The boot 1, in its general configuration has an opening 3 in the back end 4 and a smaller opening 5 in the front end 6, which openings 3 and 5 allow for the positioning of a fuel dispensing device 7 (FIG. 3) therein. The housing 2 is comprised of an open chamber having a bottom 8, top 9, front end 10, back end 11, and sides 12 and 12' (12" not shown, but is identical to side 12 for all intents and purposes).

Back end 11 has open pores 13 through it to allow for the transference of sound from the sound system contained in the housing 2.

Figure 2:
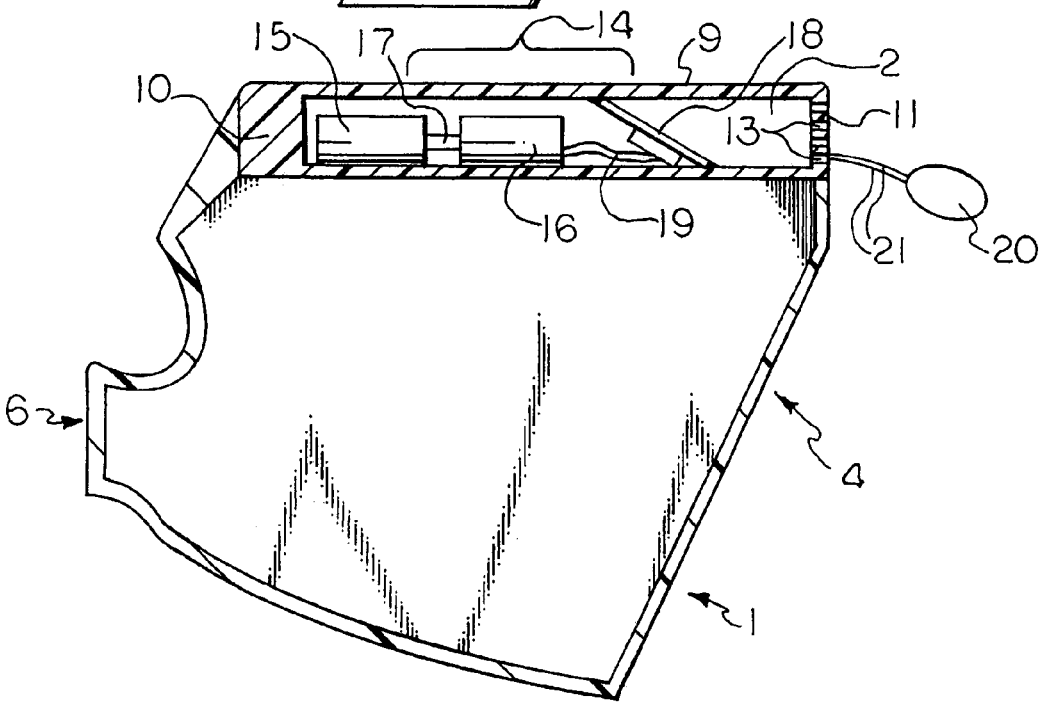
FIG. 2 is a cross-sectional full view of the flexible boot of this invention through the line A—A of FIG. 1.

With regard to FIG. 2, there is shown a full cross sectional view of the boot 1 of FIG. 1, through the lines A—A of FIG. 1. There is also shown front 6, back 4, top 9, front end 10 of the housing, back end 11 the housing and openings 13. In addition, there is shown a sound system 14, in which there is shown for purposes of illustration, a high density integrated circuit analog signal recording and playback system. This high density integrated circuit analog signal recording and playback system is electrically driven and in FIG. 2, there is shown an electrical battery pack 15, which is electrically integrated with a recording and playback system IC 16, by electrical wire pair 17. Further, there is a speaker 18, connected to the system 16 by electrical wire 19 and in addition, there is shown a switch 20, which for all intents and purposes is a mercury switch, which is linked by wires 21 to the recording and playback system 14, all of which constitute the full sound system.

Figure 3:
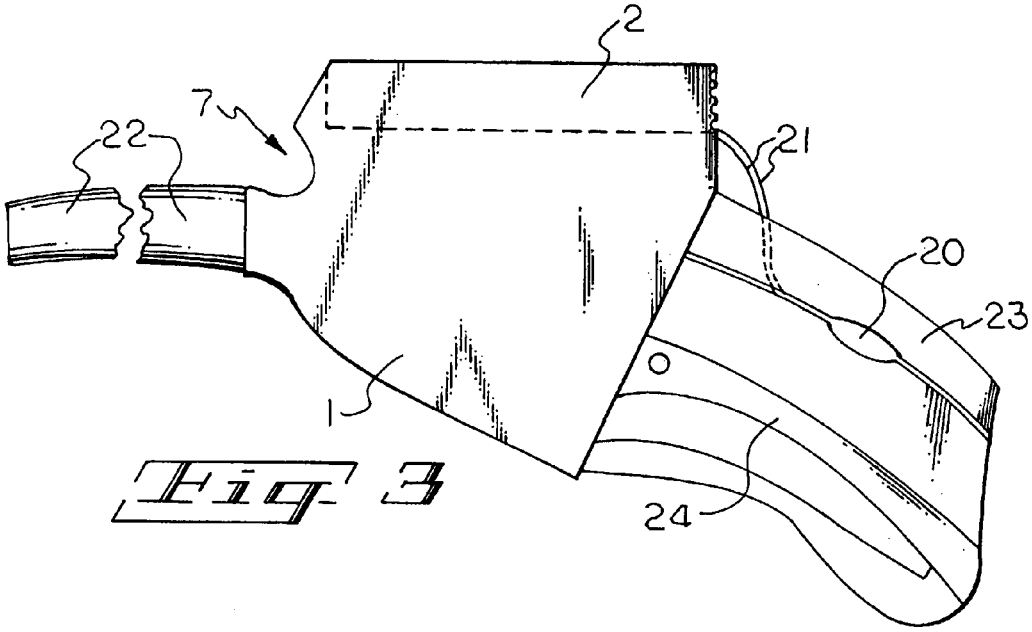
FIG. 3 is a full side view of a nozzle of this invention showing the nozzle covered with a boot.

FIG. 3 shows a full side view of the complete system including the flexible boot 1, containing the housing 2 in phantom, a nozzle 22 for the delivery of fuel to a vehicle. Further, there is shown a handle 23 for the fuel delivery system, an activating device 24 for delivery of the fuel, and the switch 20 for the activation of the sound and/or video system 14, which is shown mounted on the underside of the handle 23, along with the wires 21.

Figure 4:
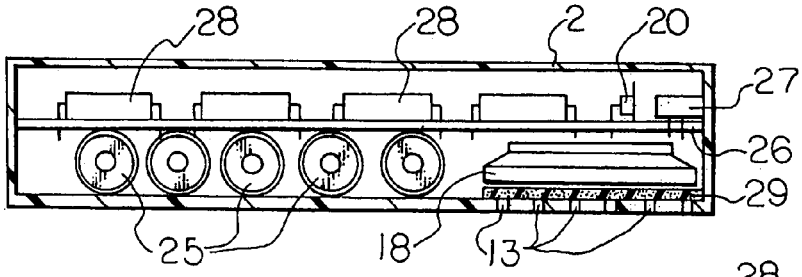
FIG. 4 is a full side view of a housing of the boot of this invention through the line A—A of FIG. 1.

In FIG. 4, there is shown only the housing of the inventive device with the housing 2, containing a series of batteries 25, speaker 18, printed circuit board 26, programming connector 27, record/playback ICs 28, and switch 20, along with the open pores 13 covered with soft mesh 29 to more easily allow the transfer of sound to outside the housing.

Figure 5:
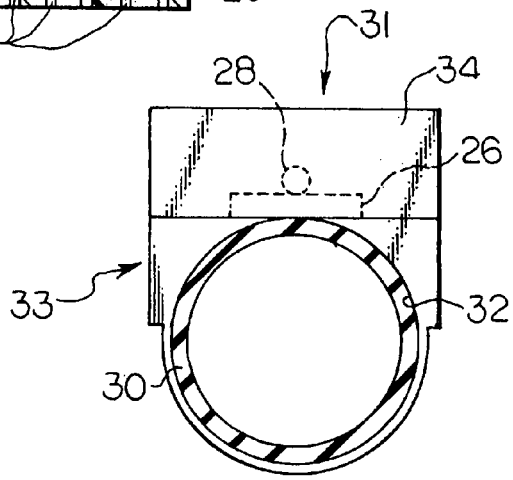
FIG. 5 is a full end cross sectional view of a device of this invention which is useful for adaptation to a fuel dispensing hose.

With regard to FIG. 5, there is shown a cross-sectional end view of a device of this invention which is adaptable to a fuel dispensing hose 30. Also shown is the boot 31, whose lower end 33 is adaptable to the outer surface 32 of the hose 30. Surmounting the lower end 33 of the boot 31 is the housing 34, which holds the recording a playback device shown in phantom as record/playback IC 28, and printed circuit board 26. As with the other boot for the nozzle, the switch for this device in best situated in the housing 34. The boot 31 is held to the hose 30 by a strap 35, or a series of straps 35.

Turning now to FIG. 6, there is shown a full back view of a nozzle of this invention with the boot 31, spout 22, handle 23, and a video screen 36 mounted in the housing of boot 31.

With regard to FIG. 7, there is shown another embodiment of a nozzle of this invention showing a cavity in the housing which accommodates a sound and/or video system.

More specifically, there is shown a nozzle 37 having a housing 38 which has a front end 39, a back end 40, a top or crown 41 and a bottom 42.

There is present a fluid flow passage 43 (shown in phantom) which extends through the housing 38, which fluid flow passage 43 consists of a spout 44 on the front end 39, and a continuing fluid channel 45 on the back end 40.

The fluid flow passage 43 has located at or near its middle point a valve system 46 which is used to control the flow of fluid through the device. There is a handle 47 located at the bottom 42 of the housing 38, the handle 47 being connected to the valve system 46 to activate and deactivate the valve system.

The top 41 of the housing 38 consists of a hollow cavity 48, which hollow cavity 48 is capable of containing a system which consists of a sound system, a video system, or a combination of them, which have been described supra, and which are indicated in 48 in phantom. Included for purposes of illustration only are a video screen 49, a speaker 50, a transceiver 51, signal storage module 52, batteries 53, a switch 54, and an antenna 57. Finally, there is shown a means 55 for activating the switch 54 by the valve system 46, and a means 56 of activating the valve system 46.

In one aspect, this invention deals with a flexible boot that is capable of having a dual purpose in fuel dispensing when used in conjunction with a fuel delivery device. Further, in its most fundamental form, this invention deals with a battery powered sound and/or video device that attaches to a fueling dispenser nozzle such that when activated, a series of sounds or viewable material is played back.

The sound and/or video systems are configured such that there is employed a device or system to receive, hold or make pre-recorded messages that can be quickly downloaded electrically and/or electronically into the signal recordation part of the sound and/or video device of the instant invention.

The video system which contains a video screen and the audio system can receive input from a recordation and playback system of the instant invention and/or can be electronically linked to a transceiver to transmit and receive wireless transmissions.

Such messages can be used to give the user of the fuel dispensing device a recorded message or a viewable program on the proper use of the device for fueling the vehicle; a message on proper safety precautions for operation of the fuel dispensing device, or more significantly, it can be used to deliver advertising messages to the fuel dispensing device user.

As such, a device or system to hold or make pre-recorded messages is utilized to establish the messages on the inventive device and this could be a series of advertising messages, or a series of safety messages, or a combination of the same. This allows for the convenient changing of the recorded messages at various times. The recordation and playback device of the instant invention has been pre-recorded such that it can hold about four to six, 20 second recorded messages for playback use. When wireless systems are used, there is virtually no limit to the types and or lengths of the messages that can be used.

In use, one wishing to fuel a vehicle using a dispensing system that is equipped with the invention disclosed herein, merely removes the fuel pump nozzle from the pump, inverts the nozzle for insertion into the fuel port of the vehicle, which activates the switch of the device of the instant invention, and a series of messages are played while the fuel is being dispensed. When the user returns the nozzle to the fuel pump, which results in the nozzle being put into an upright position, then the sound device is inactivated by the operation of the switch. The electronic configuration of the sound system allows for the messages to start from the beginning every time that the fuel pump is used, and thus, all of the messages are given essentially equal time in the playback mode.

What is claimed is:

1. A boot for a fuel dispensing nozzle, comprising:

a boot adapted to fit over at least a portion of a fuel dispensing nozzle; and a sound system mounted in said boot;

wherein said sound system includes a speaker and a playback device coupled to said speaker.

2. A boot as defined in claim 1, wherein said playback device includes a printed circuit that contains an integrated circuit having recorded messages contained thereon for audible playback through said speaker.

3. A boot as defined in claim 2, wherein said integrated circuit comprises a record/playback integrated circuit that can record received audio messages for later playback through said speaker.

4. A boot as defined in claim 3, wherein said sound system includes an antenna coupled to said integrated circuit, wherein wireless messages received via said antenna can be stored on said integrated circuit for later playback through said speaker.

5. A boot as defined in claim 1, wherein said sound system includes one or more batteries for operating said playback device and said speaker.

6. A boot an defined in claim 1, further comprising a switch for activating said sound system.

7. A boot as defined in claim 6, wherein said boot is mounted on a fuel dispensing nozzle and wherein said switch activates said sound system as a result of inverting the fuel dispensing nozzle to dispense fuel from the nozzle.

8. A boot as defined in claim 6, wherein, once activated by said switch, said sound system plays one or more audio messages and then becomes deactive.

9. A boot as defined in claim 6, wherein said sound system is housed inside an enclosed cavity within said boot.

10. A fuel dispensing nozzle, comprising:

a housing having a fluid flow passage;

a spout attached to said housing to receive fluid flowing through said passage;

a valve mounted in said housing to control the flow of fluid through said passage;

an actuator coupled to said valve for use in actuating said valve; and a sound system attached to said housing;

wherein said sound system includes a speaker and a playback device coupled to said speaker.

11. A fuel dispensing nozzle as defined in claim 10, wherein said playback device includes a printed circuit that contains an integrated circuit having recorded messages contained thereon for audible playback through said speaker.

12. A fuel dispensing nozzle as defined in claim 11, wherein said integrated circuit comprises a record/playback integrated circuit that can record received audio messages for later playback through said speaker.

13. A fuel dispensing nozzle as defined in claim 12, wherein said sound system includes an antenna coupled to said integrated circuit, wherein wireless messages received via said antenna can be stored on said integrated circuit for later playback through said speaker.

14. A fuel dispensing nozzle as defined in claim 10, wherein said sound system includes one or more batteries for operating said playback device and said speaker.

15. A fuel dispensing nozzle as defined in claim 10, further comprising a switch for activating said sound system.

16. A fuel dispensing nozzle as defined in claim 15, wherein said switch activates said sound system as a result of inverting the fuel dispensing nozzle to dispense fuel from the nozzle.

17. A fuel dispensing nozzle as defined in claim 15, wherein said actuator is coupled to said switch such that said switch activates said sound system when the actuator is operated to control fluid flow via said valve.

18. A fuel dispensing nozzle as defined in claim 15, wherein, once activated by said switch, said sound system plays one or more audio messages and then becomes deactive.

19. A fuel dispensing nozzle as defined in claim 15, wherein said sound system is located in an enclosed cavity within said housing.

20. A boot for a fuel dispensing nozzle, comprising:

a boot adapted to fit over at least a portion of a fuel dispensing nozzle; and a video system mounted in said boot.

21. A fuel dispensing nozzle, comprising:

a housing having a fluid flow passage;

a spout attached to said housing to receive fluid flowing through said passage;

a valve mounted in said housing to control the flow of fluid through said passage;

an actuator coupled to said valve for use in actuating said valve; and a video system attached to said housing.

* * * * *